US010219972B1

(12) United States Patent
Stockton

(10) Patent No.: US 10,219,972 B1
(45) Date of Patent: Mar. 5, 2019

(54) NATURAL FLOW ANTI-EMBOLISM COMPRESSOR AND LEGGINGS

(71) Applicant: Ray Stockton, Dickinson, TX (US)

(72) Inventor: Ray Stockton, Dickinson, TX (US)

( * ) Notice: Subject to any disclaimer, the term of this patent is extended or adjusted under 35 U.S.C. 154(b) by 397 days.

(21) Appl. No.: 15/051,262

(22) Filed: Feb. 23, 2016

Related U.S. Application Data

(60) Provisional application No. 62/120,332, filed on Feb. 24, 2015.

(51) Int. Cl.
*A61H 9/00* (2006.01)

(52) U.S. Cl.
CPC ... *A61H 9/0078* (2013.01); *A61H 2201/1207* (2013.01); *A61H 2209/00* (2013.01)

(58) Field of Classification Search
CPC ..... A61H 9/0078; A61H 2201/1207; A61H 2201/0103; A61H 2201/0157; A61H 2201/12; A61H 2201/1238; A61H 2201/1409; A61H 2201/164; A61H 2201/1642; A61H 2201/5043; A61H 2201/5056; A61H 2205/10; A61H 2205/106; A61H 2205/108
See application file for complete search history.

(56) References Cited

U.S. PATENT DOCUMENTS

| | | | | |
|---|---|---|---|---|
| 5,437,610 | A * | 8/1995 | Cariapa | A61H 9/0078 128/DIG. 20 |
| 8,394,042 | B1 | 3/2013 | Mirza | |
| 8,449,483 | B2 | 5/2013 | Eddy | |
| 8,579,841 | B2 | 11/2013 | Khan | |
| 2002/0133106 | A1* | 9/2002 | Peled | A43B 7/00 601/149 |
| 2005/0187500 | A1* | 8/2005 | Perry | A61H 9/0078 601/152 |
| 2011/0082401 | A1* | 4/2011 | Iker | A61H 9/0092 601/152 |

* cited by examiner

*Primary Examiner* — Quang D Thanh
(74) *Attorney, Agent, or Firm* — RG Patent Consulting, LLC; Rachel Gilboy

(57) ABSTRACT

A portable system for preventing Deep Vein Thrombosis (DVT) in hospitalized patients through a pair of successively pressurized leggings designed to assist in the return of venous blood from the legs to the heart.

11 Claims, 5 Drawing Sheets

NATURAL FLOW ANTI-EMBOLISM COMPRESSOR AND LEGGINGS

CROSS-REFERENCE TO RELATED APPLICATION

The present applications are related to and claims priority from prior provisional application Ser. No. 62/120,332 filed Feb. 24, 2015, which applications are incorporated herein by reference.

BACKGROUND OF THE INVENTION

1. Field of the Invention

The present invention relates generally to the field of sequential anti-embolism compression devices and more specifically relates to a portable system for preventing Deep Vein Thrombosis (DVT) in hospitalized patients through a pair of successively pressurized leggings designed to assist in the return of venous blood from the legs to the heart.

2. Description of the Related Art

Deep Vein Thrombosis, or DVT, is the occurrence of blood clots in the major veins of the body, almost always in the lower extremities. Clots in deep veins restrict the flow of blood returning to the heart, and one leg often becomes swollen as a result. The grave danger with DVT is that a portion of the clot, an embolus, may become detached from the main clot or thrombus, travel through the veins to the heart, and then become lodged in a pulmonary artery (pulmonary embolus), the heart, brain, or another organ, a condition that can lead to severe organ damage and, quite often, death.

According to Donald Schreiber, M.D., of Stanford University, "DVT and its sequela, pulmonary embolism, are the leading causes of preventable in-hospital mortality in the United States the true incidence of DVT suggests that about 80 cases per 100,000 persons occur annually. DVT occurs in approximately 5 percent of the population over their lifetimes, and 600,000 hospitalizations for DVT occur annually in the United States. Among hospitalized patients, the incidence of venous thrombosis is considerably higher and varies from 20-70 percent. Death from DVT is attributed to massive pulmonary embolism, which causes 200,000 deaths annually in the United States."

As much as one-third of all mortality in hospitals is due to pulmonary embolism, regardless of why the patient was admitted. Deep Vein Thrombosis is slightly more common in men than in women, and generally affects people after the age of 40, with people 60 and over at greatest risk. Since the introduction of the anticoagulant drug Heparin in 1937, DVT has been treated largely with Heparin and Warfarin, both of which dilute the clotting properties of the blood.

DVT and pulmonary embolism—known as the "silent killer"—can be brought on by long periods of immobility, such as extended hospital stays, difficult pregnancies, and even by long, economy-class airline flights. For those at risk—and this includes everyone who reaches middle age—medical authorities recommend regular exercise of the legs as a prime preventative. Muscle tone in the calves and thighs is essential to returning the venous blood, against the force of gravity, to the heart; and healthy blood circulation is essential to preventing clots, which tend to occur in locations of reduced blood flow. DVT is such a serious problem that hospitals are now under a "core measure" federal mandate to reduce its occurrence in hospitalized patients.

The mandate prescribes that non pharmacological therapies are to be preferred for all but the highest-risk (of DVT) patients, and that the risk of DVT should be addressed in all admitted patients. (Since anticoagulants dramatically reduce the blood's ability to clot, they create their own problems, particularly when patients fall and bruise or break the skin.) Thus, patients are generally treated with inflatable, compression stockings. These devices are wrapped around the legs and inflate to compress the swollen legs and force venous blood upward toward the heart. But while such stockings are helpful to those at risk for DVT, they compress the patient's entire calf region all at once, rather than in a graduated, wave-like manner. The invention to be introduced, described, and discussed in the course of this report would offer hospitals and patients, as well as travelers, a much-improved, portable therapeutic system for combating DVT.

Various attempts have been made to solve problems found in sequential anti-embolism compression devices art. Among these are found in: U.S. Pat. No. 8,579,841 to Sitara R. Khan; U.S. Pat. No. 8,449,483 to Patrick Eddy; and U.S. Pat. No. 8,394,042 to Mansoor Mirza. This prior art is representative of sequential anti-embolism compression devices.

None of the above inventions and patents, taken either singly or in combination, is seen to describe the invention as claimed. Thus, a need exists for a reliable Natural Flow Anti-embolism Compressor and Leggings, a portable system for preventing Deep Vein Thrombosis (DVT) in hospitalized patients through a pair of successively pressurized leggings designed to assist in the return of venous blood from the legs to the heart and to avoid the above-mentioned problems.

BRIEF SUMMARY OF THE INVENTION

In view of the foregoing disadvantages inherent in the known sequential anti-embolism compression devices art, the present invention provides a novel Natural Flow Anti-embolism Compressor and Leggings. The general purpose of the present invention, which will be described subsequently in greater detail, is to provide a portable system for preventing Deep Vein Thrombosis (DVT) in hospitalized patients through a pair of successively pressurized leggings designed to assist in the return of venous blood from the legs to the heart. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Natural Flow Anti-embolism Compressor and Leggings, constructed and operative according to the teachings of the present invention.

DETAILED DESCRIPTION

Figure 1:
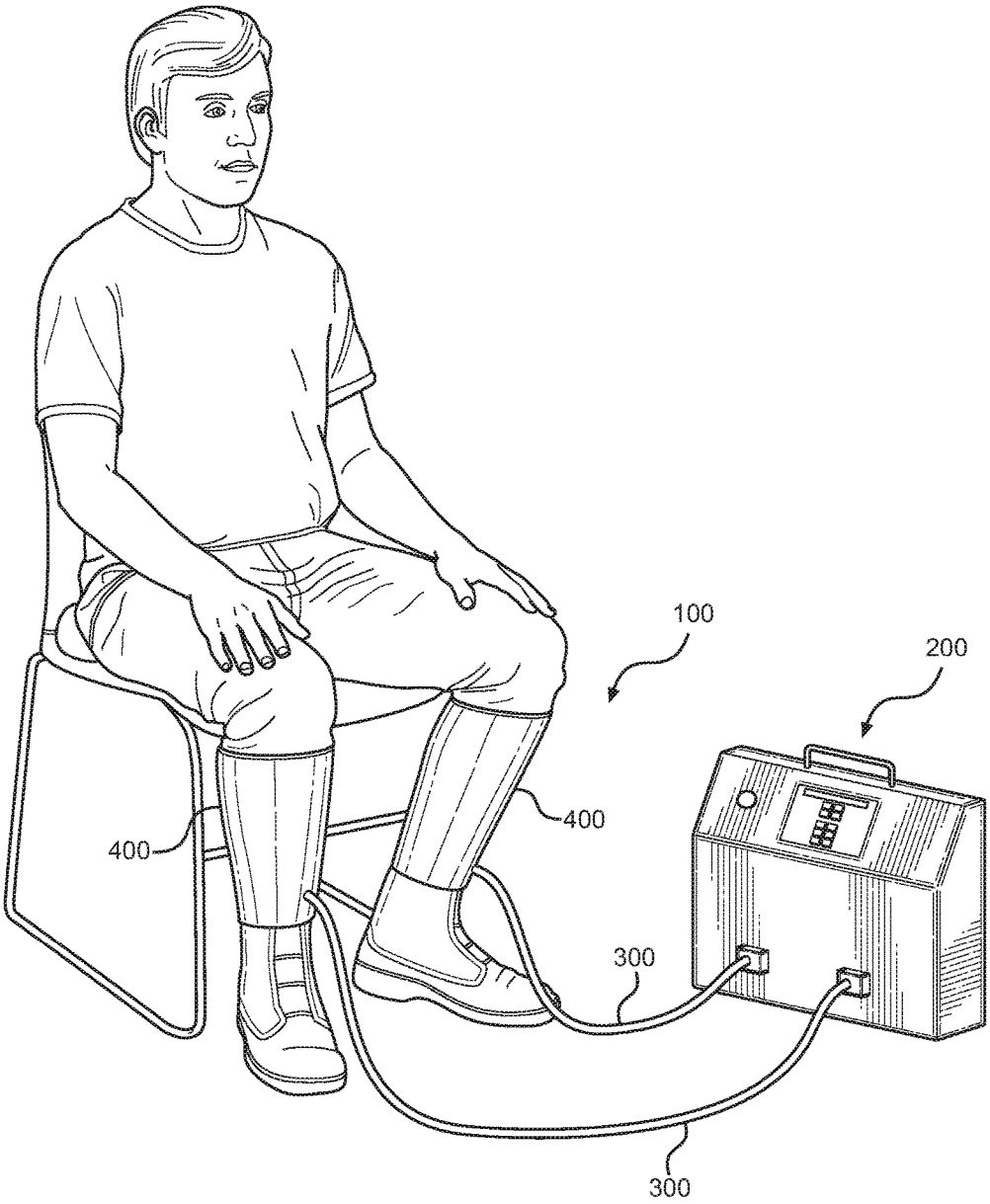
FIG. 1 shows an inside perspective view illustrating a Natural Flow Anti-embolism Compressor and Leggings according to an embodiment of the present invention in an in-use position.
Figure 2:
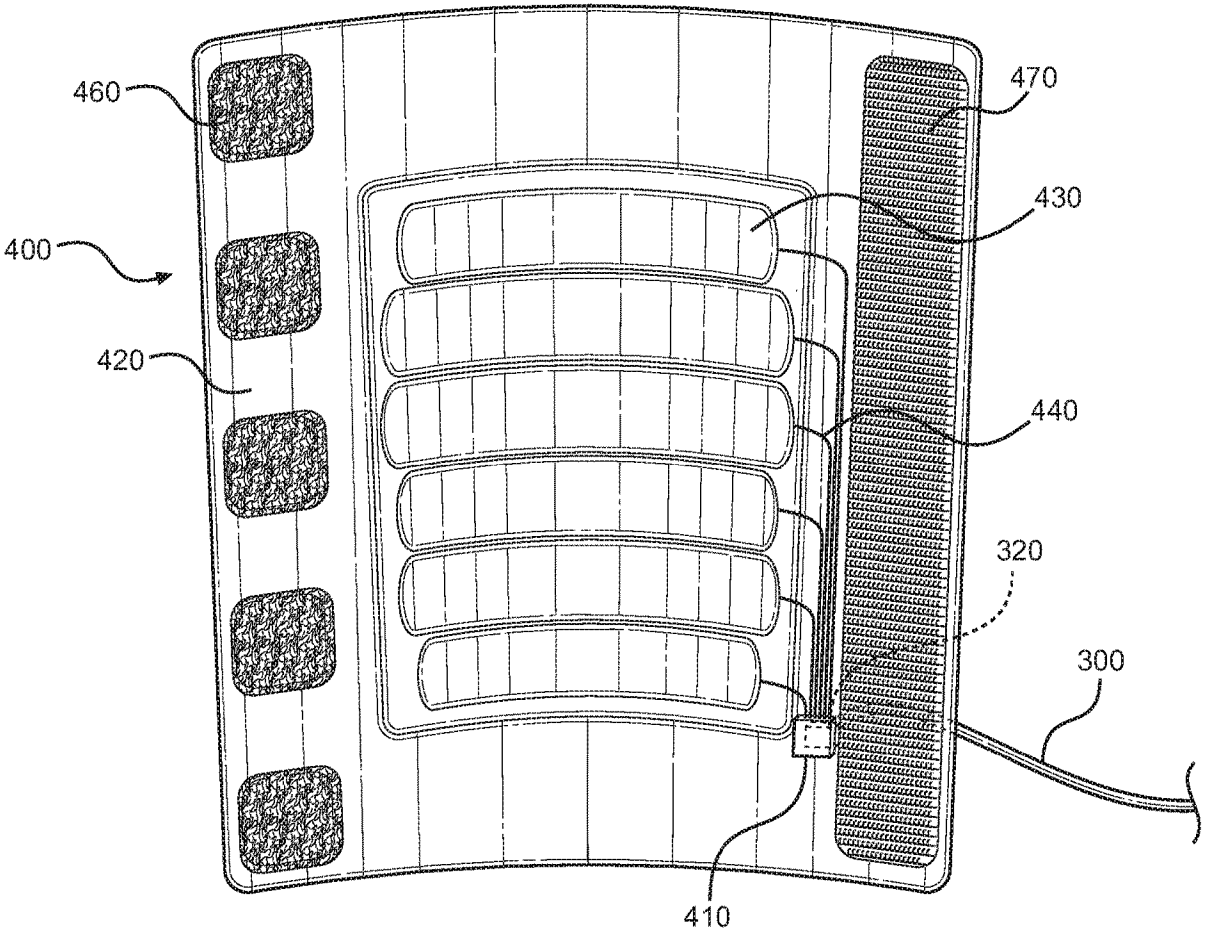
FIG. 2 shows an inside perspective view illustrating a Natural Flow Anti-embolism Compressor and Leggings according to an embodiment of the present invention.
Figure 3:
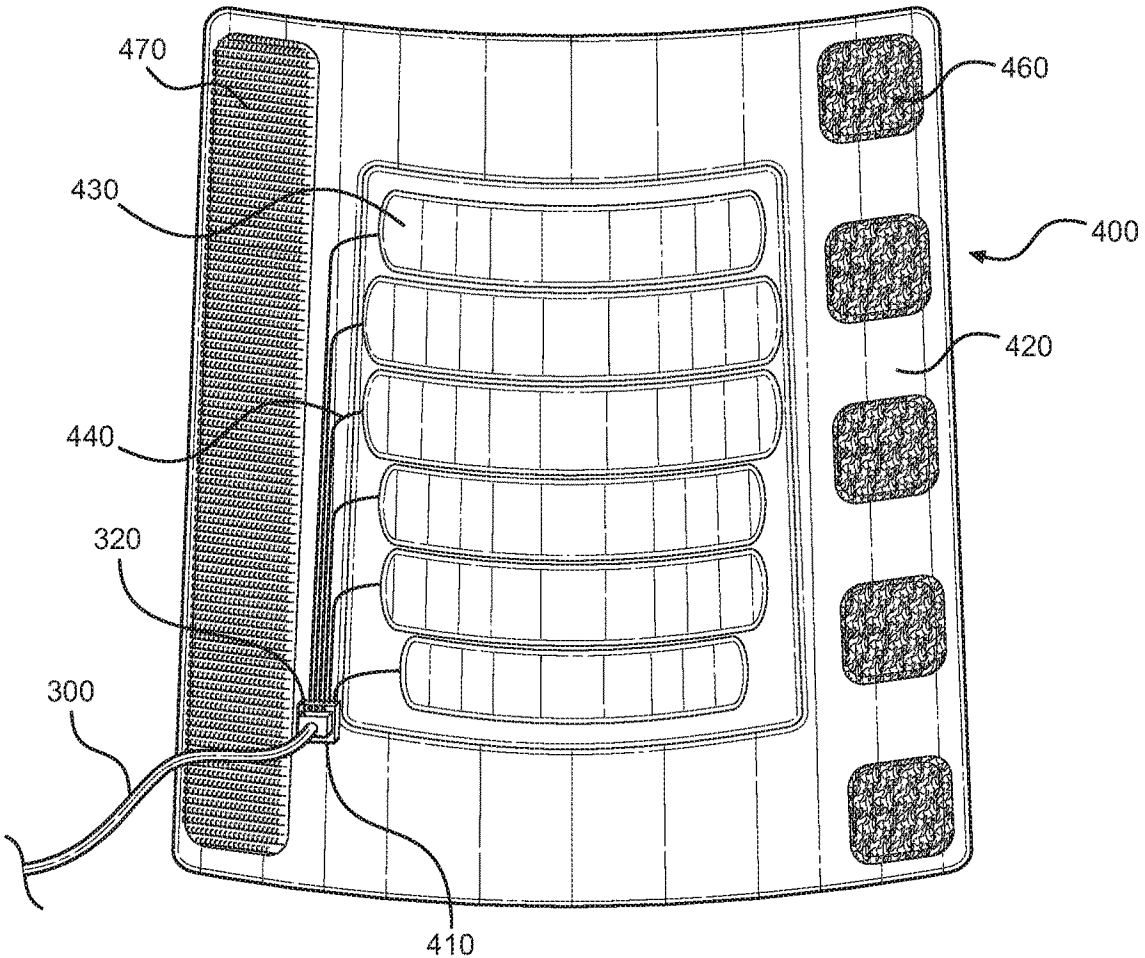
FIG. 3 shows an outside perspective view illustrating a Natural Flow Anti-embolism Compressor and Leggings according to an embodiment of the present invention.
Figure 4:
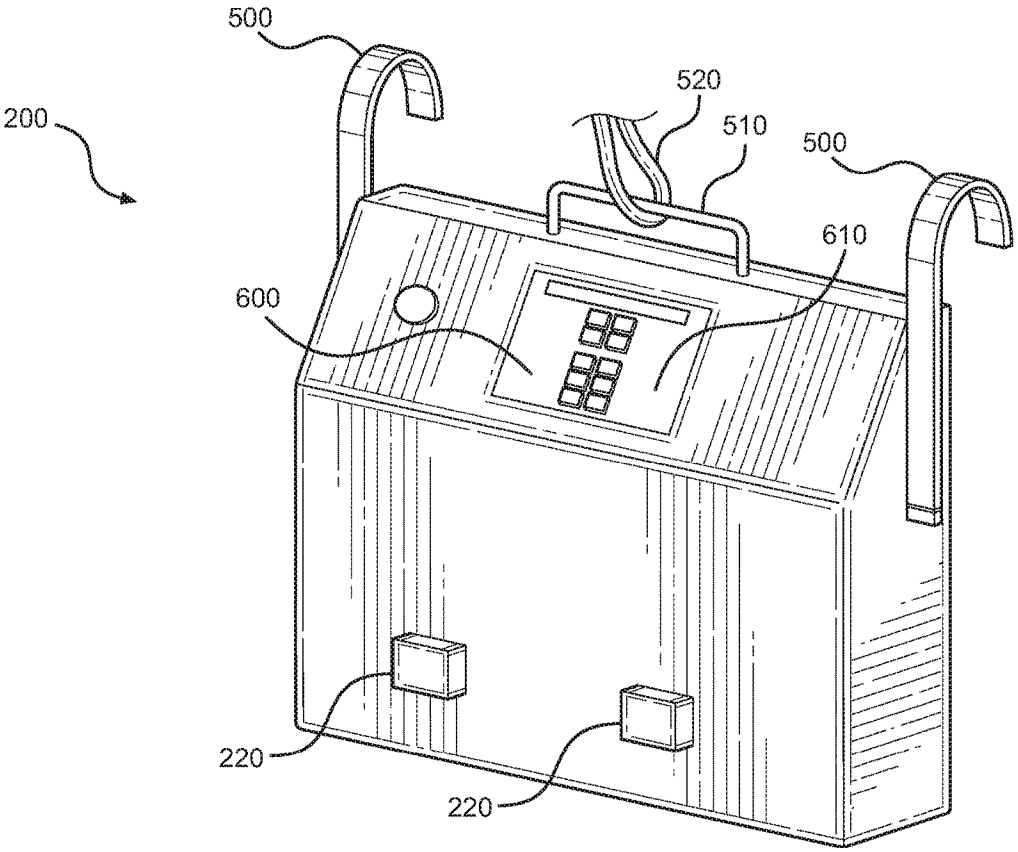
FIG. 4 shows a perspective view illustrating an air compressor of a Natural Flow Anti-embolism Compressor and Leggings according to an embodiment of the present invention.
Figure 5:
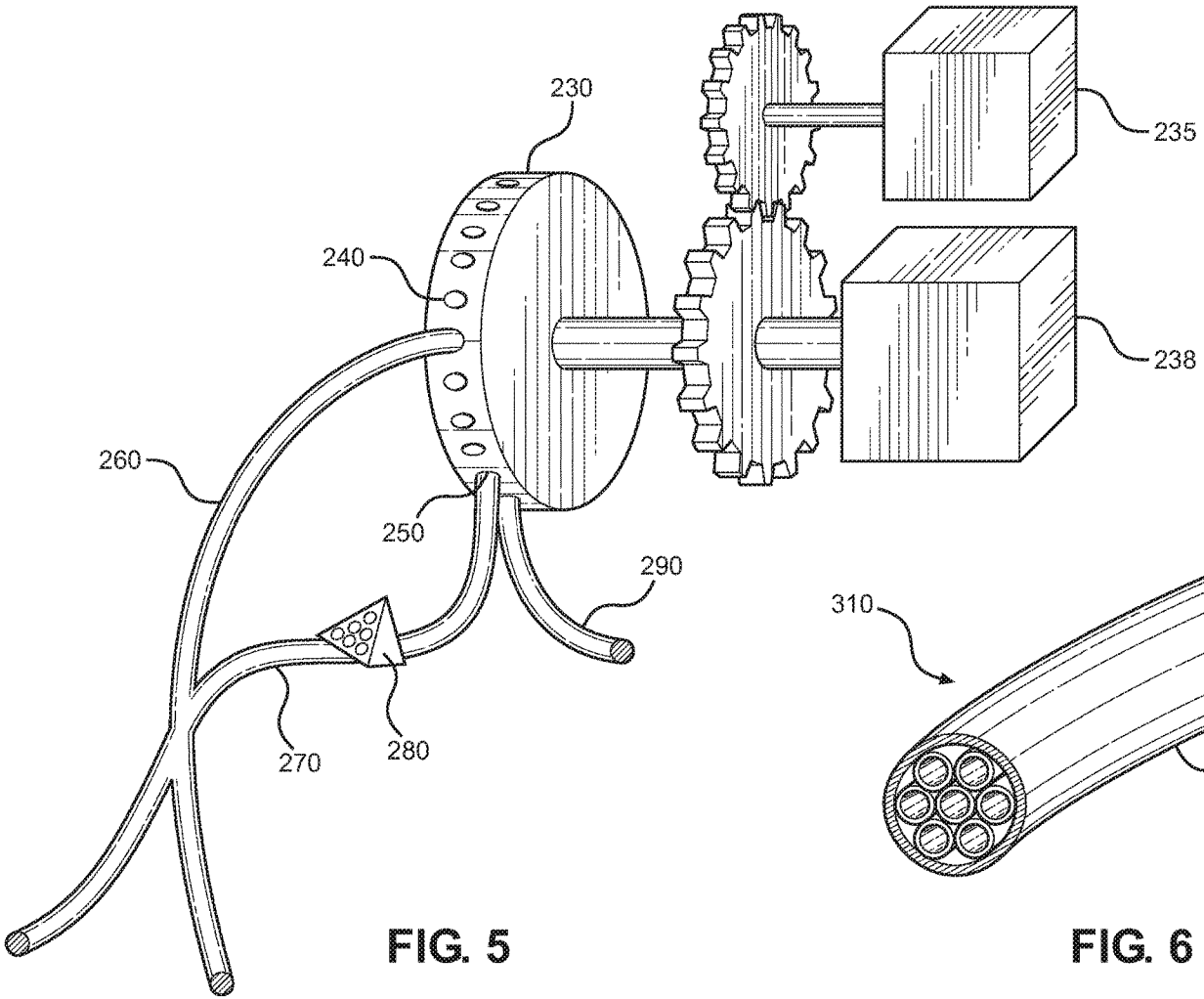
FIG. 5 shows a perspective view illustrating the rotational air chamber and air hoses within the air compressor of a Natural Flow Anti-embolism Compressor and Leggings according to an embodiment of the present invention.
Figure 6:
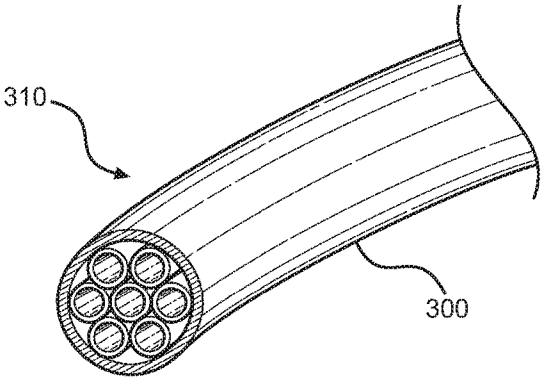
FIG. 6 shows a perspective view of the plurality of air sub-hoses of the main air bladder hoses.

As discussed above, embodiments of the present invention relate to a sequential anti-embolism compression device and more particularly to Natural Flow Anti-embolism Compressor and Leggings, a portable system for preventing Deep Vein Thrombosis (DVT) in hospitalized patients through a pair of successively pressurized leggings designed to assist in the return of venous blood from the legs to the heart.

The Natural Flow Anti-embolism Compressor and Leggings comprising a novel product offering consumers a practical solution to the aforementioned challenges. As the name implies, the Natural Flow Anti-embolism Compressor and Leggings comprises a specially designed air-compressor and a pair of inflatable leggings, the design of which is such that the leggings inflate successively, in wave-like stages, from bottom to top, thus facilitating and encouraging the return of venous blood from the legs to the heart. The leggings of the Natural Flow Anti-embolism Compressor and Leggings would be fabricated in a low-stretch, mostly natural fabric for maximum comfort and breathability.

The basic design features calf-length leggings 14 inches in length, equipped with full-length flaps or flanges that will fasten the leggings around the calves by means of regularly spaced, mating Velcro patches. Between the securing flanges or flaps each legging is equipped with a series of six air-bladders. The bladders are each 1¼ inches in height, and vary in width, from bottom to top. Each of these bladders is supplied with compressed air by a separate air-hose, the receiving fitting for which, a six-hole plug, is incorporated into the bottom of the legging. The air-hose receiver plug in each legging will receive a clip-secured, airtight mating plug from an air-supply hose, connected in turn to the system's air-compressor. The compressor unit will be AC-powered, and will measure 9 inches in length, 8 inches in height, and 4½ inches in thickness or depth.

The compressor casing will feature a pair of 6-inch, pivoting "candy-cane" hooks for hanging the unit from a bed-rail, and a 1½-inch steel hanger bar for use with a nylon web strap where the unit must be hung elsewhere. Two six-hole air-hose ports on the compressor will accommodate the two outgoing air-hoses. The top of the compressor unit will have an LCD touchscreen display and control panel, trapezoidal and measuring 3 inches in basal length, 2 inches in height, and 4 inches in top length. This display will show the six air-bladders, each lighting up as it fills; and will also have a "faulty air-pressure" warning light, and a sequence of error codes should any problems arise in functioning. A Green/Red On/Off switch will be located to the right of the display panel.

The design of the air compressor posits a central air chamber in which pressurized air is released sequentially into the six outflow air-hoses by means of two hollow cylinders, one within the other, and both equipped with six outflow valves and six return or inflow valves. The two cylinders rotate relative to one another, and as the respective valves or holes in the two cylinders line up, pressurized air is first conducted out of the chamber, through the hose(s) to the six legging bladders in each legging—sequentially—and then, as the cylindrical rotation continues, the air which filled the bladders is in turn released back into the hose(s). The repeated, successive, wave-like compression of the legging bladders will squeeze the calves (and, in the thigh-length version, the entire legs), and effectively stimulate and encourage the return of lower-extremity venous blood toward the heart.

The design intent of the Natural Flow Antiembolism Compressor and Leggings is to provide effective, nonpharmacological therapy and reduce the likelihood of a patient's developing DVT, the "silent killer" that precedes pulmonary embolism. This would be accomplished by providing sequential, ankle-to-knee compression—compression that will replicate and mimic the compression of the calves which occurs in walking, and which effectively moves the lower-extremity venous blood upward toward the heart. The wave-like, successive compression of the individual bladders is paramount, as the Natural Flow Antiembolism Compressor and Leggings would be more effective in combating DVT by nonpharmacological means—a federally mandated goal for all hospitals—than existing equipment. The Natural Flow Antiembolism Compressor and Leggings is cost-effective to produce in the embodiments, as shown in FIG. 1.

Referring now to the drawings FIG. 1, the anti-embolism air compressor and leggings system 100 comprises an air compressor 200 that includes a motor 210 adapted to provide compressed air sequentially into two main air bladder hoses 300, wherein the two main air bladder hoses are releasably connected to the motor and are adapted to respectively and releasably attach to two separate leggings 400 of a pair of leggings. The two main air bladder hoses 300 are adapted to transfer the compressed air to and from the pair of leggings 400, wherein each of the main air bladder hoses includes a plurality of air sub-hoses 310 therein and a multi-hose air plug 320 on a distal end thereof attached respectively to each of the plurality of air sub-hoses, and is adapted to releasably attach to a respective multi-hose air receiver 410 of a respective legging of the pair of leggings. The pair of leggings 400 each include a main panel 420 formed of flexible material adapted to be removable wrapped around and secured to a person's leg, a plurality of air bladders 430 evenly spaced from one another and attached to the main panel, wherein each of the plurality of air bladders 430 are adapted to be filled with compressed air from the air compressor, a plurality of air hoses 440 attached to the main panel 420 and respectively attached to each of the plurality of air bladders 430, wherein each of the plurality of air hoses 440 are adapted to receive and send compressed air to and from the air compressor and send and receive the compressed air to respective air bladders of the plurality of air bladders, and the multi-hose air receiver 410 attached to the main panel and attached respectively to each of the plurality of air hoses 440, and is adapted to releasably receive the multi-hose air plug 320 of a respective main air bladder hose 300, such that the air compressor provides compressed air sequentially into and out of the pair of leggings 400 in order to provide the legs of a user with controlled and variable waves of compression and stimulate the return of lower extremity blood toward the user's heart.

In the preferred embodiment, the plurality of air sub-hoses 310 of each of the two main air bladder hoses 300 equals six; the plurality of air hoses 440 of each of the leggings of the pair of leggings equals six; and the plurality of air bladders 430 for each of the leggings of said pair of leggings also equals six. Furthermore, the main panel of each the pair of leggings further includes hook and loop fasteners 460 and 470 on opposite sides thereon which are adapted to releasably hold said main panels around and in place upon a user's respective legs.

The air compressor motor can be powered by alternating current electricity. The air compressor may further include at least one hook member 500 attached thereto and adapted to allow the air compressor to be hung from a bed rail. Furthermore, the air compressor may further include a hanger bar 510 and a strap member 520 attached thereto adapted to allow the air compressor to be hung from various support structures. The air compressor may further include an electronic control panel and display 600 attached thereto adapted to control the flow of compressed air, and to provide a user with information pertaining to the inflation and deflation rate and amounts of compressed air within each of the air bladders of each legging in real time. The electronic control panel and display may further include a warning light 610 for the presence of air pressure within any said air bladder predetermined by said user to be dangerous.

In a preferred embodiment the pair of leggings 400 would both be 14-inches in length, the plurality of air bladders 430 would be 1.25-inches in height and vary in width successively. Furthermore, the air compressor 200 would be no larger than 9-inches in length, 8-inches in height, and 4.5-inches in thickness.

In a more detailed description of the air compressor 200, a preferred embodiment would include a rotational air chamber 230 having a plurality of air hose ports 240 and at least two exhaust ports 250; a rotational air chamber motor 235; a compressor member 238; and an air chamber hose 260 adapted to be supplied with compressed air from said plurality of air hose ports and adapted to handle returning air coming back therein and into an exhaust port. Furthermore, the air chamber hose 260 forms an X-shape and is attached to and is adapted to provide compressed air to and from both of the two main air bladder hoses 300; and wherein the X-shape of said air chamber hose includes a returning air portion 270 having a pyramid-shaped air hose connector 280 attached therein and is adapted to allow for controlling returning air coming back into said rotational air chamber. And an exhaust port tube 290 for exhausting said returning air from the rotational air chamber.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An anti-embolism air compressor and leggings system comprising:

an air compressor including:

a motor;

two main air bladder hoses;

wherein said motor is adapted to provide compressed air sequentially into said two main air bladder hoses;

a rotational air chamber including:

a plurality of air hose ports and at least two exhaust ports; and an air chamber hose;

wherein said air chamber hose is adapted to be supplied with compressed air from said plurality of air hose ports, and adapted to handle returning air coming back therein and into said at least two exhaust ports;

wherein said air chamber hose forms an X-shape and is attached to and is adapted to provide compressed air to and from both of said two main air bladder hoses; and wherein said X-shape of said air chamber hose includes a returning air portion having a pyramid-shaped air hose connector attached therein and is adapted to allow for controlling returning air coming back into said rotational air chamber; and a pair of leggings, wherein each legging comprises:

a main panel formed of flexible material adapted to be removable wrapped around and secured to a person's leg;

a plurality of air bladders evenly spaced from one another and attached to said main panel, wherein each of said plurality of air bladders are adapted to be filled with compressed air from said air compressor;

a plurality of air hoses attached to said main panel and respectively attached to each of said plurality of air bladders, wherein each of said plurality of air hoses are adapted to receive and send compressed air to and from said air compressor and send and receive said compressed air to respective air bladders of said plurality of air bladders; and a multi-hose air receiver attached to said main panel and attached respectively to each of said plurality of air hoses, and is adapted to releasably receive a multi-hose air plug of a respective main air bladder hose;

wherein said two main air bladder hoses are releasably connected to said motor and are adapted to respectively and releasably attach to said two separate leggings of said pair of leggings;

wherein said two main air bladder hoses are adapted to transfer said compressed air to and from said pair of leggings;

wherein each said main air bladder hose includes a plurality of air sub-hoses therein, and said multi-hose air plug on a distal end thereof attached respectively to each of said plurality of air sub-hoses, and adapted to releasably attach to said respective multi-hose air receiver of a respective legging of said pair of leggings; and wherein said air compressor provides compressed air sequentially into and out of said pair of leggings in order to provide the legs of said person with controlled and variable waves of compression and stimulate lower extremity blood toward said person's heart.

2. The anti-embolism air compressor and leggings system of claim 1, wherein said plurality of air sub-hoses of each said two main air bladder hoses equals six; said plurality of air hoses of each said legging of said pair of leggings equals six; and said plurality of air bladders for each said legging of said pair of leggings equals six.

3. The anti-embolism air compressor and leggings system of claim 1, wherein said main panel of each said pair of leggings further includes hook and loop fasteners on opposite sides thereon adapted to releasably hold said main panels around and in place upon said person's respective legs.

4. The anti-embolism air compressor and leggings system of claim 1, wherein said air compressor motor is powered by alternating electric current.

5. The anti-embolism air compressor and leggings system of claim 1, wherein said air compressor further includes at least one hook member attached thereto adapted to allow said air compressor to be hung from a bed rail.

6. The anti-embolism air compressor and leggings system of claim 1, wherein said air compressor further includes a hanger bar and a strap member attached thereto adapted to allow said air compressor to be hung from various support structures.

7. The anti-embolism air compressor and leggings system of claim 1, wherein said air compressor further includes an electronic control panel and display attached thereto adapted to control flow of compressed air, and to provide said person with information pertaining to inflation and deflation rates and amounts of compressed air within each said air bladder of each said legging in real time.

8. The anti-embolism air compressor and leggings system of claim 7, wherein said electronic control panel and display further including a warning light for the presence of air pressure within any said air bladder predetermined by said person to be dangerous.

9. The anti-embolism air compressor and leggings system of claim 1, wherein said pair of leggings are both 14-inches in length.

10. The anti-embolism air compressor and leggings system of claim 1, wherein said plurality of air bladders are 1.25-inches in height and vary in width successively.

11. The anti-embolism air compressor and leggings system of claim 1, wherein said air compressor is no larger than 9-inches in length, 8-inches in height, and 4.5-inches in thickness.

* * * * *